United States Patent [19]

Johnson

[11] Patent Number: 4,871,321

[45] Date of Patent: Oct. 3, 1989

[54] ELECTRICAL CONNECTOR

[75] Inventor: Lennart B. Johnson, Milford, N.H.

[73] Assignee: Teradyne, Inc., Boston, Mass.

[21] Appl. No.: 171,909

[22] Filed: Mar. 22, 1988

[51] Int. Cl.[4] ..... H01R 9/00

[52] U.S. Cl. ..... 439/79; 439/108

[58] Field of Search ..... 439/62, 79–83, 439/108

[56] References Cited

U.S. PATENT DOCUMENTS

Re. 29,513 1/1978 Johnson ..... 339/112 R 4,550,962 11/1985 Czescha ..... 439/79

4,655,518 4/1987 Johnson et al. ..... 339/17 C 4,659,155 4/1987 Walkup et al. ..... 439/108

4,734,042 3/1988 Martens et al. ..... 439/79

OTHER PUBLICATIONS

AMP HDI TM Series 100 Surmount TM 6 Row Receptacle (Future Center Ground Plane).

*Primary Examiner*—P. Austin Bradley

[57] ABSTRACT

Electrical connector in which contact pins extending from separate portions thereof are adapted to enter a circuit board from both sides.

16 Claims, 3 Drawing Sheets

ELECTRICAL CONNECTOR

FIELD OF THE INVENTION

This invention relates to electrical connectors, and in particular to such devices useful in the connection of backplanes and daughter boards.

BACKGROUND OF THE INVENTION

Electrical connectors useful in connecting to daughter boards and to other units for connecting to backplanes are known: e.g., U.S. Pat. No. 4,655,518, Johnson et al., "Backplane Connector", hereby incorporated by reference herein.

Other such connectors are known in which one face of a daughter board is positioned adjacent to a vertical surface of the connector and contacts extending from the connector are soldered to the other face of the daughter board; e.g., the now recently-disclosed AMP HDI Series 100 Surmount (its claimed trademark) connector.

SUMMARY OF THE INVENTION

I have discovered that such a connector with considerable mechanical and electrical advantages can be provided if there is provided for each daughter board a pair of separately assemblable to connector portions mounted to the daughter board, the connector portions being provided with contacts press-fittable into holes in the daughter board.

In preferred embodiments, my connector unit includes addtional means for securing one connector portion to the other, and a metal stiffener plastic block system interconnecting the connector unit and daughter board.

EMBODIMENT

The presently preferred embodiment of my invention is as shown in the drawings and now described.

DRAWINGS

DESCRIPTION

Figure 1:
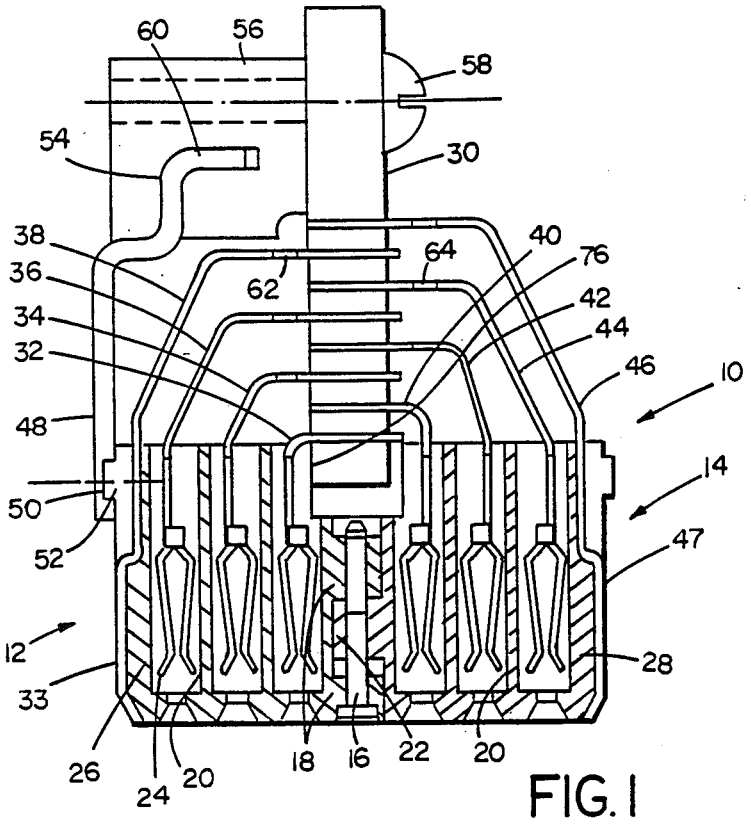
FIG. 1 is an end elevation showing the housing portions of the connector portions of the preferred embodiment in transverse vertical section.
Figure 2:
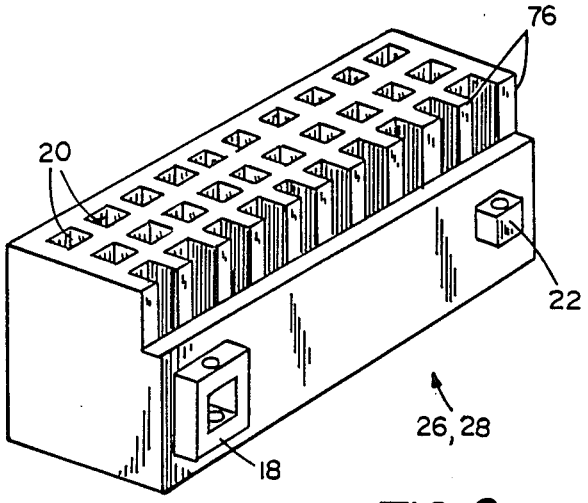
FIG. 2 is an isometric view of the molded plastic housing of said embodiment.

Connector 10 includes two connector portions 12 and 14 held together by a pair of pins 16 extending respectively at one end (shown in FIG. 1) through holes in protuberances 18 of portion 12 and 22 of portion 14 and at the other end (not shown) through holes in protuberances 18 of portion 14 and 22 of portion 12, a set of such protuberances being provided toward each longitudinal end of said portions. The housings 26, 28 have the same configuration, as illustrated in FIG. 2, and are engageable as shown in FIG. 1 when their projections 18, 22 are aligned upon rotation of one with respect to the other.

Longitudinally-extending row of vertical abutment surfaces 76 is provided on molded plastic housings 26, 28 of portions 12, 14, and supports thereon daughter board 30, one larger surface of which abuts abutments 76.

Contacts 32, 34, 36, 38 have upper portions terminating in ends with split portions as disclosed in U.S. Pat. No. Re. 29,513, Johnson, "Electrical Connection Apparatus", issued January 10, 1978, and of overall width of 0.030 inches, press-fitted into 0.025 inch solder-coated holes of daughter board 30, and with lower ends having female portions 24 press-fitted into slots 20 of portions 12, except that contact 38 is secured on the outer part of portion 12 in the manner disclosed in Pat. No. 4,655,518 above mentioned.

Contacts 40, 42, 44, 46 are similarly secured to portion 14 and press-fitted in daughter board 30. The holes in daughter board 30 engaging these contacts are vertically staggered from those engaging the contacts from portion 12, each longitudinal row of contacts from portion 14 being halfway between each longitudinal row of contacts from portion 12, except that the highest row of contacts 46 is a corresponding distance above row 38.

Connector 10 is suited to engage a backplane connector element as shown at 16 in said U.S. Pat. No. 4,655,518.

Stainless steel stiffener 48 engages at groove 50 thereof longitudinal protuberance 52 of portion 12. Upper portion 54 of stiffener 48 is in longitudinally sliding relation with a corresponding slot extending longitudinal through plastic block 56, into which is secured self-threading screw 58, which holds block 56 and daughter board 30 together. The horizontal portion 60 of stiffener 48 extends before tightening of the screw 58 downwardly in the direction of the daughter board at an angle of 1°, so that on tightening of screw 58 a force in the direction of the daughter board is imposed by stiffener 48 at protuberance 52.

Each portion 12 and 14 is greater in length (i.e., the longitudinal direction) than width (that shown in FIG. 1), and includes a multiplicity of contacts including female portions in longitudinal rows. Stiffener 48 and daughter board 30 are secured to a plurality of connectors 10. Blocks 56 are short in the direction longitudinal of the daughter board, stiffener, and connectors 10, and are fewer in number than said connectors.

Figure 3:
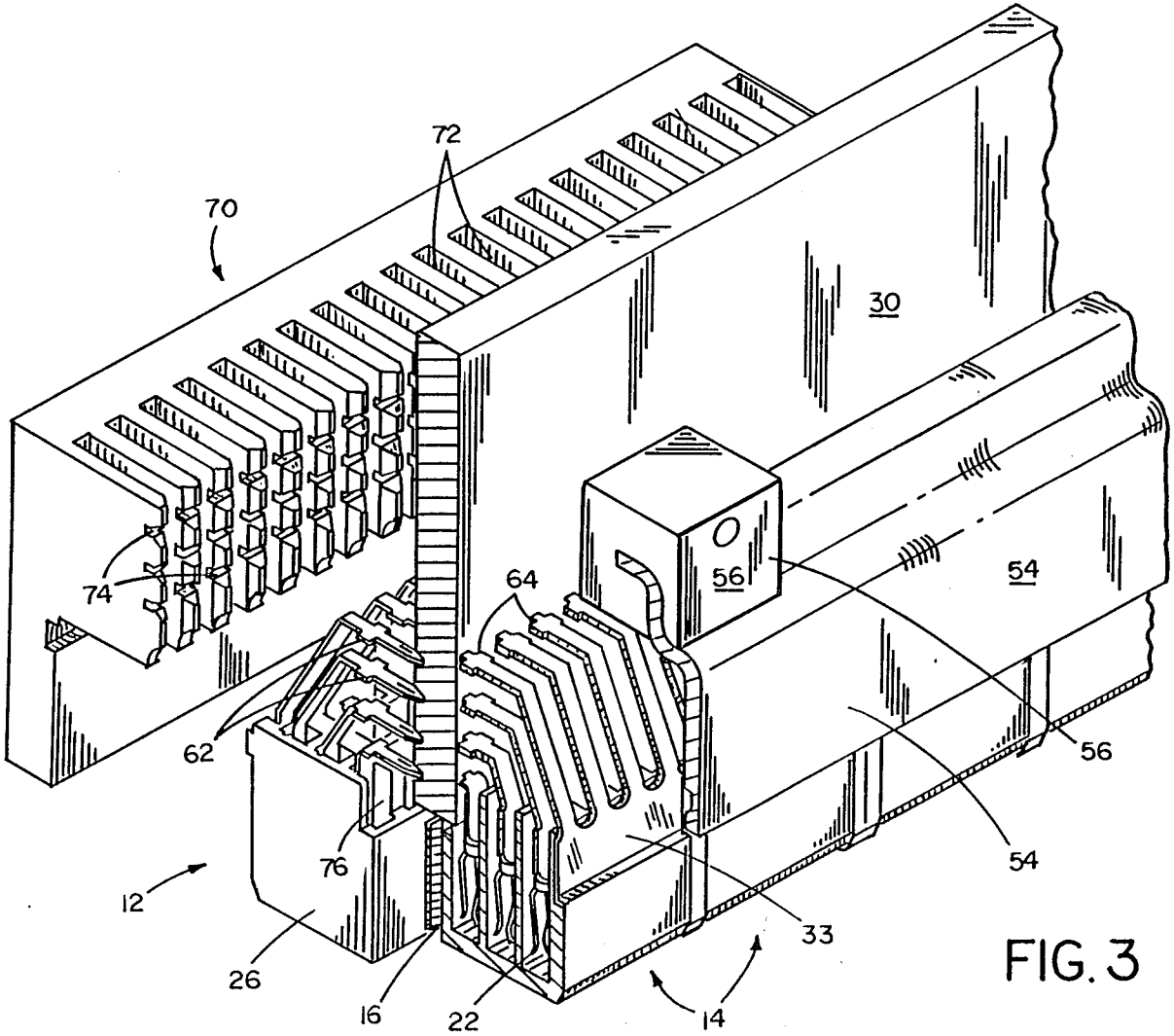
FIG. 3 is a broken-away isometric view of several of said embodiments assembled to a daughter board.
Figure 4:
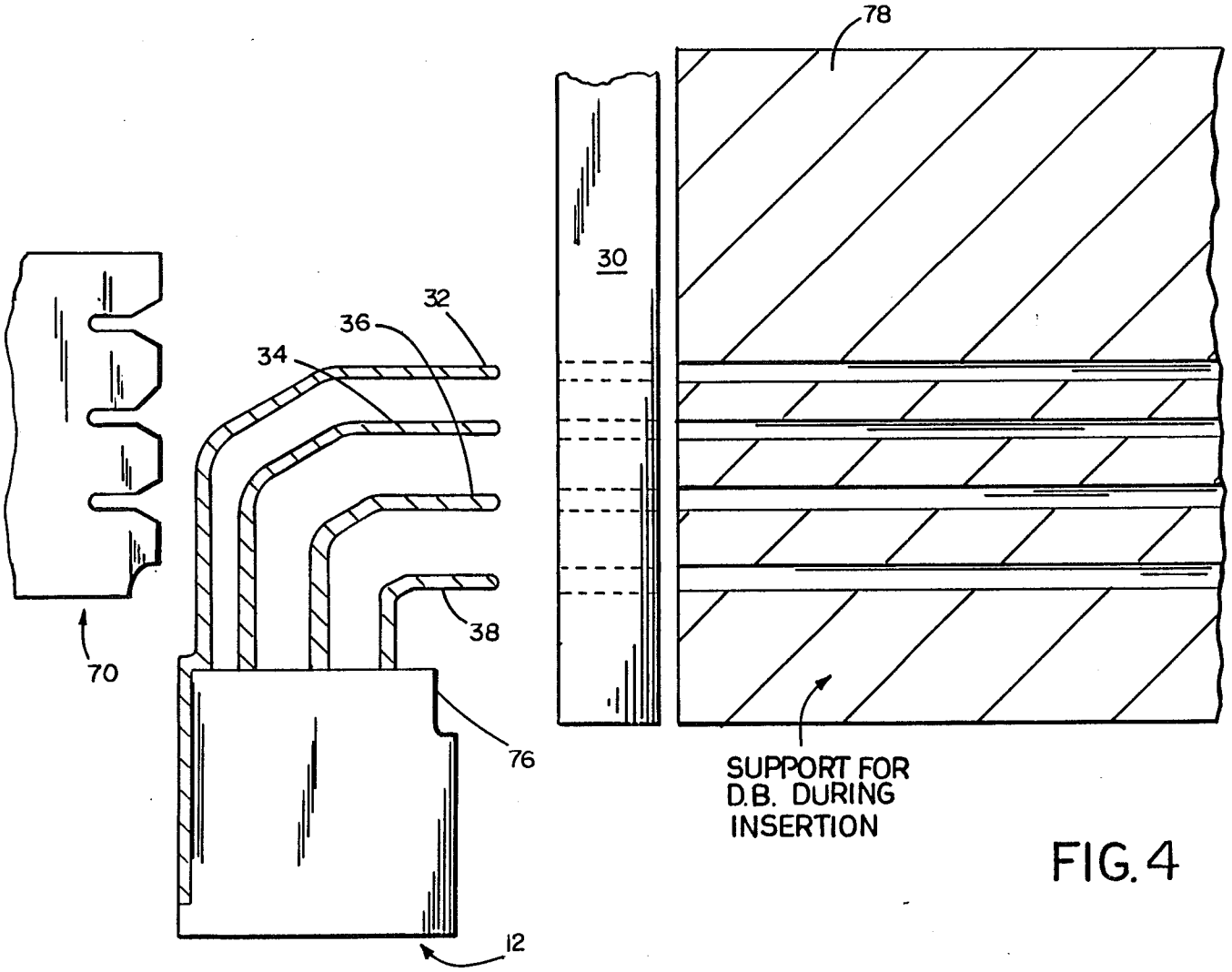
FIG. 4 is an exploded end elevation, partially in section and somewhat diagrammatic, of a step in the assembly.

In assembly, contacts are first mounted in their respective housings of portions 12 and 14. The contacts from portion 12 are then pressed as a group into the respective holes of daughter board 30, using the tool 70 shown in FIG. 3; slots 72 permit the contacts to move thereinto, enabling slots 74 to engage protuberances 62, 64 and drive the contacts press-fittedly into the soldered-through holes provided for them, the insertion stopping upon engagement by the daughter board 30 surface of abutments 76 of housing 26. Support 78 cooperates with the daughter board 30 to support the latter while the contacts of portion 12 are being inserted. The contacts of portion 14 are then inserted in daughter board 30, reversing of course the locations of tool 70 and support 78. Daughter board 30 is supported only by the contacts from portions 12 and 14, being out of contact with any other support both along its face opposite that abutting abutments 76 and along its edge therebetween and above portions 12 and 14.

The longitudinally outermost contact row nearest each end of each connector is spaced closely enough to the respective said end that the distance to the outermost contact row adjacent it of the adjacent connector may be the same as the distance between connectors, in a direction longitudinal of the connectors and daughter board, within a connector.

My invention has many mechanical and electrical advantages. Contact length is both shorter and more uniform, and contact mass may be greater, as may contact separation. Inductance, resistance, and cross-talk may be reduced. Reliability is good. Outer rows of contacts 38 and 46, connected to grounding portions 33 and 47 of character the same as the lower portions 36 of said U.S. Pat. No. 4,655,518 provide the entire contact zone with a surrounding shielding.

Other embodiments of the invention will occur to those skilled in the art.

I claim:

1. A daughter board connector element for electrically connecting a daughter board to a perpendicular backplane comprising a first housing piece that includes an upper portion for connection to a major surface of said daughter board near one end of said daughter board and a lower portion that extends downward beyond said end toward the backplane, said first housing piece being substantially located on one side of a plane passing through said daughter board between its major faces, means to secure said first housing piece to a second housing piece for a second connector element adapted to be connected to the other major surface of said daughter board near said end of said daughter board and to be substantially located on the other side of said plane passing through said daughter board, said means extending from said lower portion transverse to and through said plane below said end, and a plurality of contacts extending from said lower portion of said first housing piece and through said upper portion of said first housing piece, said contacts being located in said housing outward from said plane of said means to secure.

2. The element of claim 1 in which said upper portion of said first housing piece includes board abutment means.

3. The connector element of claim 1 wherein said contacts bend at angles greater than 90° above said upper portion of said first housing piece.

4. The connector element of claim 1 wherein said means to secure includes first and second spaced portions of said first housing piece that are adapted to respectively mate with spaced second and first mating portions of said second housing piece, respectively, the first and second housing pieces having the same shape.

5. The combination comprising a daughter board, and a connector for electrically connecting said daughter board to a perpendicular backplane, said connector including a housing and contacts that are press-fitted into holes through said board and extend from both sides of said board and bend downwardly through said housing, said holes receiving contacts from one side being staggered from said holes receiving contacts from the other side, said holes being spaced from each other by less than the spacing between said contacts in said housing.

6. The combination of claim 5 in which outer contact rows of said housing are ground rows, whereby the remainder of said contacts are surrounded thereby.

7. The combination of claim 5 wherein said holes are vertically staggered and wherein the vertical spacing of said holes through said daughter board is less than the horizontal spacing of contacts in said housing.

8. The combination of claim 7 wherein said contacts bend at angles greater than 90° above said housing piece.

9. The combination of claim 7 wherein contacts from opposite sides of said daughter board are alternated in said holes in said daughter board along a vertical axis.

10. The combination of claim 5 wherein said housing comprises first and second housing pieces that are each substantially located on opposite sides of a plane passing through said daughter board between its major faces.

11. The combination of claim 10 wherein at least one said housing piece includes means to secure said first housing piece to said second housing piece, said means extending from a lower portion of one said housing piece that is below the end of said daughter board, said means extending transverse to and through said plane, said contacts being located in said housing pieces outward from said plane of said means to secure.

12. The combination of claim 11 which includes a stiffener interconnecting said board and a longitudinally spaced plurality of pairs of said housing pieces.

13. The combination of claim 12 in which said stiffener is metal with an upward S-curved portion and in which said portion is slidably seated in a groove of a block secured to said board.

14. The combination of claim 11 wherein said means to secure includes mating portions of said housing pieces that interlock said pieces to each other.

15. The combination of claim 14 in which each said housing piece includes two spaced said mating portions and wherein both said housing pieces are identical, a first said portion of one said housing piece being interlockable with a second said portion of another said housing piece.

16. The combination of claim 15 in which the first said portion is an enclosure for a protuberance, and the second said portion is said protuberance.

* * * * *